United States Patent [19]

Schosek

[11] 3,988,003

[45] Oct. 26, 1976

[54] PIPE GUIDE MEANS FOR A ROD AND PIPE PUSHER

[76] Inventor: William O. Schosek, Box 3626, North Fort Myers, Fla. 33903

[22] Filed: June 26, 1975

[21] Appl. No.: 590,847

Related U.S. Application Data

[63] Continuation-in-part of Ser. No. 482,275, Sept. 24, 1974, Pat. No. 3,907,253.

[52] U.S. Cl. ..... 254/29 R

[51] Int. Cl.[2] ..... E21B 19/00

[58] Field of Search ..... 254/29 R, 30, 31; 226/196, 197, 199

[56] References Cited

UNITED STATES PATENTS 3,645,502 2/1972 Stromp ..... 254/29 R

*Primary Examiner*—Al Lawrence Smith
*Assistant Examiner*—Robert C. Watson
*Attorney, Agent, or Firm*—Alfred E. Wilson

[57] ABSTRACT

This invention pertains to a guide means for a device used for example to install a pipe under a finished surface such as a driveway or street. The guide means comprises an upper and a lower rear guide roller for a rod or pipe being actuated by the device and two pairs of upper and lower rollers mounted relative to the front of the device. The rear pair of rollers and the two pairs of front rollers are arranged to permit passage between the respective pairs of rollers of a coupling, joining two rod lengths, without said coupling being in contact with more than one roller at any one time.

2 Claims, 7 Drawing Figures

PIPE GUIDE MEANS FOR A ROD AND PIPE PUSHER

This is a continuation in part of my co-pending application entitled "Pipe Guide Means for a Rod and Pipe Pusher", Ser. No. 482,275 filed Sept. 24, 1974 now U.S. Pat. No. 3,907,253 issued Sept. 23, 1975.

BACKGROUND OF THE PRESENT INVENTION

When a pipe is to be installed under a finished surface such as a driveway or street, it is a routine procedure to provide operating and target trenches on the opposite sides of the finished surface. The pipe installing device generally replaces the bucket on a standard tractor-mounted hydraulic backhoe and the device is properly located and braced in the operating trench for the rod pushing operation. A first rod length is inserted through a pair of drive jaws in the device and drivingly engage thereby to push said first rod length under the finished surface. The trailing end of the first rod length is provided with a coupling to receive a second rod length whereupon the hydraulic drive means of the tractor is reactivated to push the second rod length forwardly under the finished surface toward the target trench. A sufficient plurality of rod lengths are similarly coupled to proceeding rods until the leading tip end of the first rod length emerges into the target trench.

The leading tip end is threadably provided with a pusher cap which is removed therefrom in the target trench and replaced by an adaptor for connection to the leading end of a pipe to be permanently installed under the above surface; said pipe being so installed by reconditioning the bracing means and drive jaws to reverse the direction of movement to pull the pipe back through the hole formed by the rod until the leading end thereof, coupled to the rod, emerges into the operating trench.

The above described operations are quite conventional, however difficulties are often encountered with such conventional devices because the rod or pipe is not accurately guided by the pusher device. For example, various obstructions such as rocks are sometimes encountered causing a deflection in the direction of movement of the rod, until it pushes out of the conventional guides of the device. Devices of this type are often used to install underground pipes for distances up to several hundred feet and a slight initial deflection of the rod is magnified tremendously over such long distances.

The pipe guide means of the present invention provides a plurality of front and back guide rollers, applicable to various underground pipe installing devices, which provide for a more accurate pipe installation job.

OBJECTS AND ADVANTAGES OF THE PRESENT INVENTION

One of the principal objects of the present invention is to provide upper and lower pairs of guide rollers, adjacent the front and back ends of an underground pipe installing device for attachment, for example, to a tractor-mounted hydraulic backhoe.

Another object of this invention is to provide a single pair of upper and lower guide rollers relative to the back end of the pipe installing device and two pairs of upper and lower guide rollers relative to the front end thereof.

A further object of the instant invention is to provide each of said front and back pairs of upper and lower rollers in predetermined spaced apart, vertical, parallel planes.

Yet another object of this invention is to provide transversly rounded grooves in the respective pairs of upper and lower rollers to embrace a rod or pipe passing therebetween to prevent vertical or lateral displacement thereof.

DETAILED DESCRIPTION OF THE DRAWINGS

Figure 1:
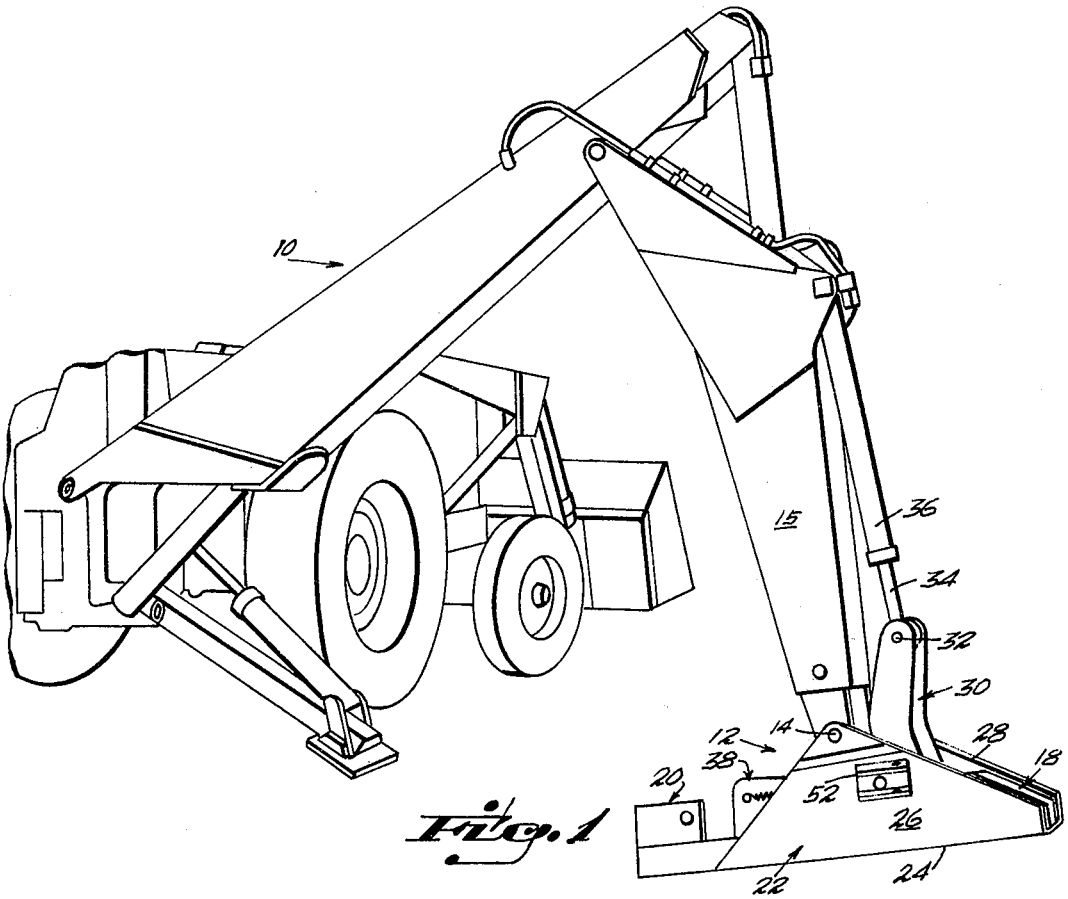
FIG. 1 is a perspective view of a conventional tractor-mounted backhoe machine with a pipe pusher, embodying the present invention, replacing the bucket on the bottom end of the dipper stick thereof.

With reference to the drawings in which like reference characters designate like or corresponding parts throughout the various views, and with particular reference to FIG. 1, a standard tractor-mounted hydraulic backhoe machine is designated generally at 10 with an underground pipe installing device 12 pivotally attached at 14 to the distal end of the dipper stick 15 in a conventional manner. The pipe installing device 12 replaces the backhoe bucket and utilizes the backhoe hydraulics for movement thereof into an operating trench 16 as well as in performing the pipe installing operations as hereinafter briefly described. The front and back guide means of the present invention are respectively designated 18 and 20.

Figure 5:
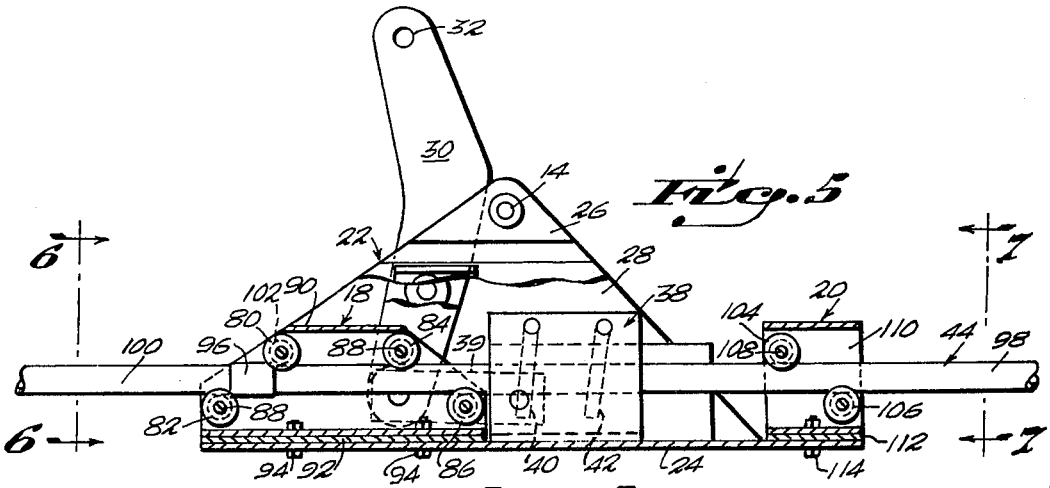
FIG. 5 is a side elevational view of the device, shown partly in section.
Figure 6:
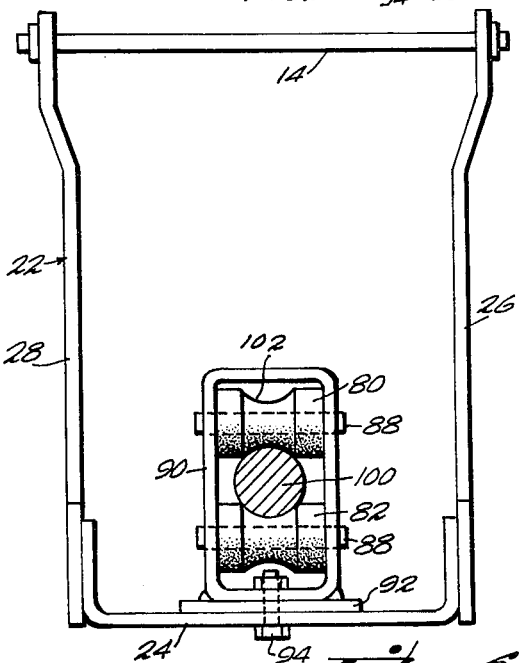
FIG. 6 is a front elevational view of the front guide means as seen along line 6—6 of FIG. 5.
Figure 7:
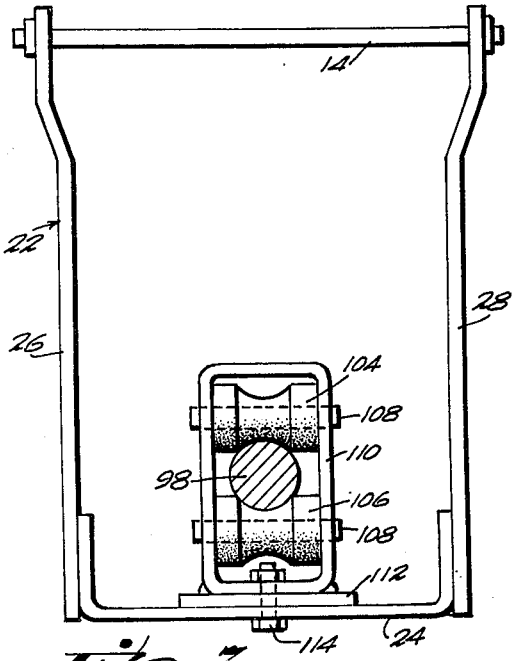
FIG. 7 is a back elevational view of the back guide means as seen along the lines 7—7 of FIG. 5.

Briefly, a typical pipe installing device includes a generally channel shaped main body portion 22 comprised of a bottom 24 and a pair of upstanding side walls 26 and 28, pivotally attached at 14 to the end of the dipper stick 15. A power arm 30 carried by the device is pivotally attached at 32 to the outer end of a piston rod 34 of a hydraulic cylinder 36 to impart reciprocating movement by means of a links 39, to a slide box 38, slidably engaged along the bottom 24. As seen in FIG. 5, two jaws 40–42, carried by the slide box 38, engage a rod or pipe 44 to impart longitudinal movement thereto. Means (not shown) are provided to reverse the drive jaws to selectively impart a pushing or pulling movement to the rod or pipe 44. The above described structure is quite conventional and is not illustrated in complete detail but is intended to supply sufficient background for the guide means of the present invention.

Figure 2:
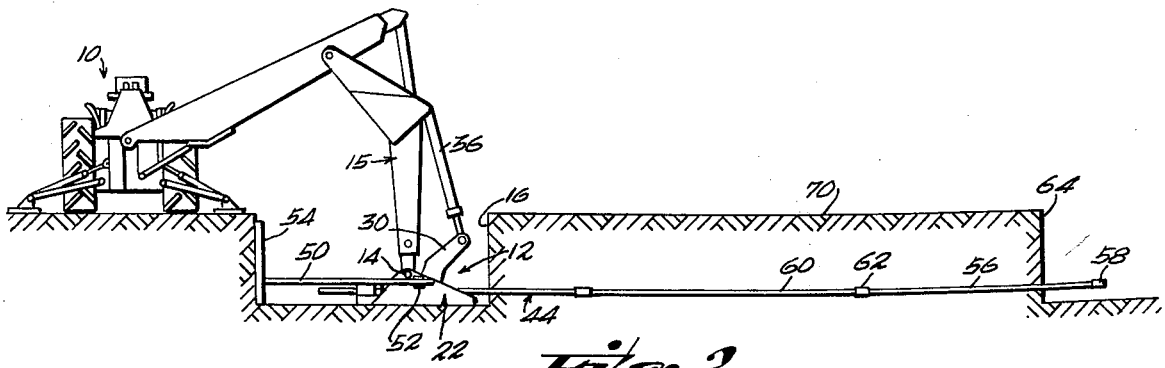
FIG. 2 is a schematic view illustrating the rod pushing operation of the device.

In use, the pipe pusher 12 is first positioned in the operating trench 16 as illustrated in FIG. 2. The pusher device 12 is braced for the push operation by a pair of side, longitudinal legs such as 50, fixed thereto by means of U-brackets 52 pivotally attached to the respective side walls 26 and 28. A backing member 54 is engaged between the rear ends of legs 50 and the rear wall of the operating trench 16.

A first length of rod 56, including a front pusher cap 58 is inserted through the slide box jaws 40 and 42 and the slide box is actuated by means of the hydraulic cylinder 36, piston rod 34 and power arm 30 to push the first rod section 56 into the soil. A second section of rod 60 is attached by a coupling 62 to the rear end of the first section 56 while the rear end of same is still clear of the back guide 20. This process is repeated with following rod sections and couplings until the pusher cap 58 emerges into the target trench 64.

Figure 3:
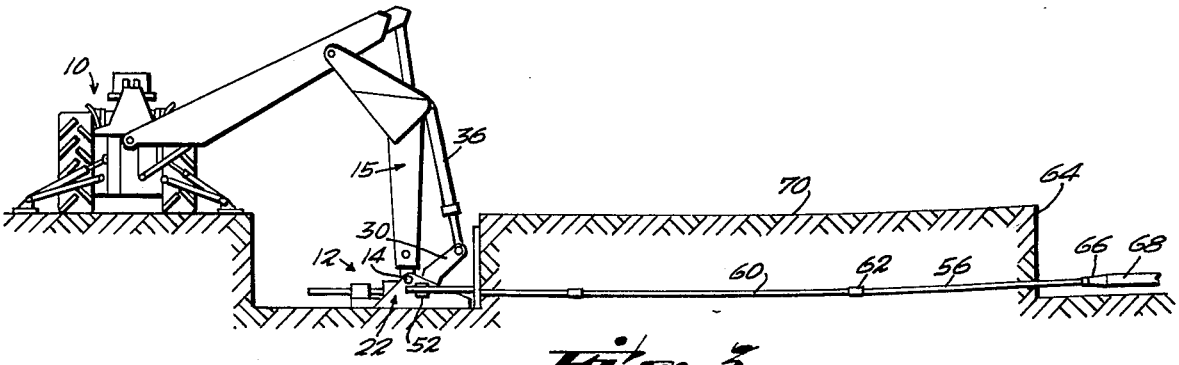
FIG. 3 is a schematic view illustrating a pipe attached to the leading end of the rod in position to be pulled back through the hole formed by the rod.
Figure 4:
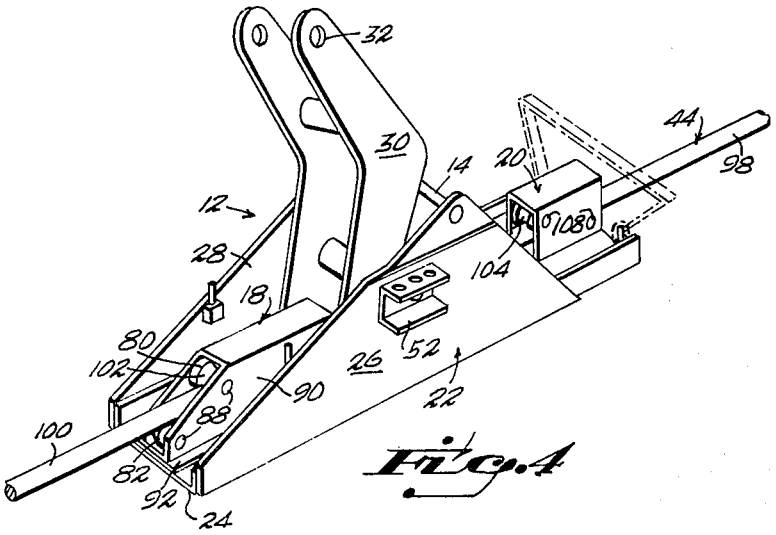
FIG. 4 is a perspective view of an underground pipe installing device incorporating the guide means of the present invention.

After the rod section 56 has entered the target trench, the pusher cap 58 is removed and replaced by a suitable adapter 66, FIG. 3, to threadably receive the pipe 68 which is to be permanently installed beneath the span 70 between the trenches 16 and 64. This is accomplished by reversing the drive jaws 40 and 42 whereupon subsequent actuation of the power arm 30 by means of piston 36 will withdraw the pipe 68 through the rod hole until it enters the operating trench 16 whereupon said pipe 68 will be properly installed.

The front guide means 18 is comprised of two pairs of upper and lower guide rollers, front, upper and lower rollers 80 and 82 and back, upper and lower rollers 84 and 86. The four rollers are transversely journalled on like pins 88, extending between the side walls of a generally rectangular tube 90, longitudinally mounted as by welding to a base member 92, bolted as at 94 to the front end portion of the main frame bottom 24.

The upper rollers 80 and 82 are longitudinally spaced apart between the longitudinal spacing of the lower rollers 82 and 86. The rollers of each individual pair 80–82 and 84–86 are vertically spaced apart in a staggered relationship to provide a longitudinal distance therebetween which is somewhat greater than the length of one coupling such as 96 in FIG. 5. Therefore when the rod section such as 98 and 100, joined by coupling 96, are being driven in either direction by the power arm 30 as previously described, a coupling such as 96 will sequentially pass over or under only one roller at a time and never be in contact with a pair of rollers at the same time. All of the rollers 80–82 and 84–86 are provided with annular cross sectionally rounded grooves such as 102 conforming generally to the radius of a rod such as 98 passing therebetween. As each pair of rollers is vertically spaced apart a distance to provide a snug engagement with the rod, it is essential to provide the staggered relationship between the respective upper and lower rollers of each spaced apart pair to accomodate the couplings.

The back guide means 20 is comprised of a single, pair of upper and lower rollers 104 and 106 transversely journalled on like pins 108, extending between the side walls of a generally rectangular tube 110, longitudinally mounted as by welding to a base member 112, bolted as at 114 to the back end portion of the main frame bottom 24. The spacing, design and general operation of the back rollers 104 and 106 conform with the front roller pairs and need no further explanation.

In operation, a rod length is inserted through the back guide rollers 104 and 106 the drive jaws 40 and 42 and the two front pairs of guide rollers 80–82 and 84–86. The hydraulic cylinder 34 is activated to drive the rod forwardly into the soil by means of the power arm and the drive jaws 40 and 42. The various pairs of front and rear rollers snugly embrace and maintain an accurate direction control of the rod sections as they are driven through the soil. The vertical spacing between the grooved top and bottom rollers of each of said pairs permits a snug roller control of the rods while permitting enlarged rod couplings to pass therebetween. For example, a standard rod is 1⅝ inches in diameter and the couplings between the rod sections are 1¾ inches in diameter. The couplings are 2⅜ inches long and the longitudinal spacing between each pair of upper and lower rollers is 3⅛ inches. Obviously, the rollers could be sized, configurated and spaced apart to perform the same function relative to other sizes of rods and couplings.

I claim:

1. A pipe guide means for attachment to a pipe installing device of the type used to push a rod in coupled sections under a finished surface such as a driveway, street, etc., and to pull a pipe back through the hole formed by the rod, said device being reversably actuated by a conventional power means while positioned in an operating trench on one side of the finished surface with a target trench on the opposed side thereof, said guide means comprising:

A. a front guide assembly comprised of two spaced apart pairs of rollers, each pair comprising an upper and a lower roller, rotatably journalled in a first housing comprising a generally rectangular tube longitudinally fixed relative to the front end portion of the bottom wall of a main body portion of the pipe installing device, the upper and lower rollers of each pair being provided with cooperating annular grooves and being vertically spaced apart in a staggered relationship whereby a rod passing therebetween, is snugly engaged in said grooves while permitting one of the rod couplings to pass between the upper and lower rollers without being engaged by both rollers at the same time;

B. a rear guide assembly comprised of one pair of upper and lower rollers rotatably journalled in a second housing means, fixed relative to the rear end portion of the pipe installing device in alignment with said front guide assembly rollers, said one pair being configurated, and vertically spaced apart and staggered similar to one pair of said front guide rollers.

2. The pipe guide means as defined in claim 1 wherein said second housing comprises a generally rectangular tube longitudinally fixed relative to the back end portion of said bottom wall in alignment with said first housing.

* * * * *